US005384087A

United States Patent [19]

Scorey

[11] Patent Number: 5,384,087

[45] Date of Patent: Jan. 24, 1995

[54] ALUMINUM-SILICON CARBIDE COMPOSITE AND PROCESS FOR MAKING THE SAME

[75] Inventor: Clive Scorey, Cheshire, Conn.

[73] Assignee: Ametek, Specialty Metal Products Division, Wallingford, Conn.

[21] Appl. No.: 863,787

[22] Filed: Apr. 6, 1992

[51] Int. Cl.[6] ..... B22F 3/18

[52] U.S. Cl. ..... 419/10; 419/14; 419/17; 419/23; 419/32; 419/43; 419/50; 419/56; 419/57; 419/69; 75/236; 75/249

[58] Field of Search ..... 419/10, 14, 17, 23, 419/32, 43, 50, 56, 57, 69; 75/236, 249

[56] References Cited

U.S. PATENT DOCUMENTS

| | | | |
|---|---|---|---|
| 3,194,858 | 7/1965 | Storchheim | 264/111 |
| 3,331,684 | 7/1967 | Storchheim | 75/208 |
| 4,042,384 | 8/1977 | Jackson et al. | 75/214 |
| 4,463,058 | 7/1984 | Hood et al. | 75/229 |
| 4,623,388 | 11/1986 | Jatkar et al. | 75/232 |
| 4,661,154 | 4/1987 | Faure | 75/231 |
| 4,722,751 | 2/1988 | Akechi et al. | 75/232 |
| 4,722,754 | 2/1988 | Ghosh et al. | 148/11.5 A |
| 4,743,512 | 5/1988 | Marlowe et al. | 428/552 |
| 4,756,753 | 7/1988 | Miura | 75/232 |
| 4,923,532 | 5/1990 | Zedalis et al. | 148/159 |
| 4,946,500 | 8/1990 | Zedalis et al. | 75/232 |
| 5,022,918 | 7/1991 | Koike et al. | 75/229 |

*Primary Examiner*—Donald P. Walsh
*Assistant Examiner*—Chrisman D. Carroll
*Attorney, Agent, or Firm*—Bachman & LaPointe

[57] ABSTRACT

The present invention relates to a process for making an aluminum silicon carbide composite material in strip form. The process comprises blending a powdered aluminum matrix material and a powdered silicon carbide material, roll compacting the blended powdered materials in an inert atmosphere to form a green strip having a first thickness, and directly hot working the blended and roll compacted materials to bond the aluminum matrix material particles and the silicon carbide particles and to form a thin strip material having a desired thickness.

20 Claims, 1 Drawing Sheet

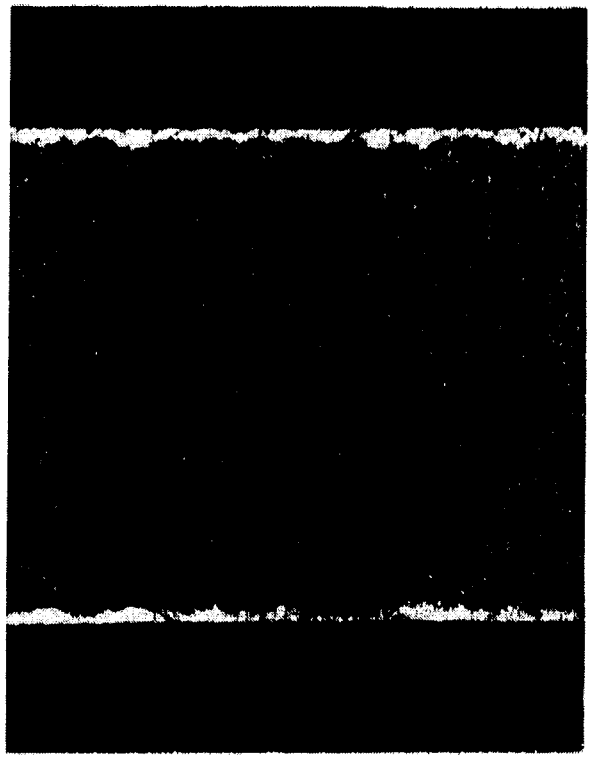

ALUMINUM-SILICON CARBIDE COMPOSITE AND PROCESS FOR MAKING THE SAME

BACKGROUND OF THE INVENTION

The present invention relates to a composite material comprising an aluminum strip reinforced with silicon carbide particles and a process for manufacturing said composite material. The process of the present invention avoids the use of vacuum processing steps utilized in conventional powder metallurgy techniques.

Composites comprising aluminum products reinforced with hard particles such as silicon carbide are known in the art. They have been used in a wide variety of applications including pistons for automotive engines and engine liners. Aluminum strip reinforced with a particulate such as silicon carbide, aluminum oxide, or aluminum nitride is a particularly attractive material because of highly attractive properties such as a higher elastic modulus than aluminum, a similar density to aluminum, good thermal conductivity, low thermal expansion and good tensile properties.

U.S. Pat. No. 4,623,388 to Jatkar exemplifies one type of process for producing such an aluminum composite. In this process, particles of the matrix metallic material and particles of a reinforcing material are subjected to energetic mechanical milling. The milling causes the metallic matrix material to enfold around each of the reinforcing particles while the charge being subjected to energetic milling is maintained in a powdery state. This type of milling provides a strong bond between the matrix material and the surface of the reinforcing particle. After this energetic mechanical milling is completed, the resultant powder is hot pressed in a vacuum or otherwise treated by sintering. The compressed and treated powder is then mechanically worked to increase density and provide engineering shapes for use in industry. This process is carried out at temperatures which do not cause the matrix metal to liquify (melt), wholly or partially.

U.S. Pat. No. 4,722,751 to Akechi illustrates a mechanical alloying/high energy milling process, Similar to Jatkar's, for forming a composite powder from which parts such as automotive engine components can be fabricated. In this process, heat resistant particles are first blended with a rapidly solidified aluminum alloy powder, pure metal powders or master alloy powders. The blended powders are then formed into a composite powder by a mechanical alloying technique After alloying, the composite material is subject to working such as compacting and sinter forging, cold isostatic pressing and hot forging, hot pressing or cold isostatic pressing and hot extrusion.

U.S. Pat. No. 4,661,154 to Faure exemplifies a powder metallurgy process for forming a low friction, anti-seizure product based on an aluminum alloy, a solid lubricant and at least one ceramic. In this process, a mixture of the aluminum alloy, solid lubricant and ceramic(s) is formed and then compressed in a cold condition. Thereafter, the compressed material is hot extruded in an extrusion press or sintered in the hot condition.

Commercial efforts to make a reinforced aluminum strip such as aluminum-silicon carbide have included liquid metal processes and powder metallurgy processes. The liquid metal processes such as stirring particulate into molten aluminum and casting a shape suffer from several disadvantages. For example, the volume fraction of particulate is limited to less than about 30 percent in this type of process because the mixture becomes too viscous to mix. Further, reaction rates between the liquid aluminum and the silicon carbide particulate can result in the formation of aluminum carbide which tends to degrade composite properties. From an economic standpoint, the fabrication costs of reducing the ingot to thin sheet are quite high.

Powder metallurgy processes offer a way of making much higher volume fraction composites, at least 70 percent particulate, and avoid the chemical reactivity problem. The first step of most commercial processes however involves placing the ingot in some suitable container, evacuating all atmosphere, and hot pressing or hot isostatically pressing the ingot. The principal disadvantages of this approach are that it is an expensive batch-type process and that the subsequent fabrication costs to prepare thin sheet are considerable.

It has been felt by some that aluminum-silicon carbide strip material can only be formed using a vacuum process which avoids such problems as oxidation of the aluminum powders, residual gas entrapment, and the low green strength of higher volume fraction particulates. Additionally, it was thought that the considerable deformation involved in an extrusion step was necessary to homogenize the particulate distribution and to ensure adequate bonding of matrix and particulate so that full tensile and thermal properties would be attained.

SUMMARY OF THE INVENTION

Accordingly, it is an object of the present invention to provide an improved powder metallurgy process for forming an aluminum-silicon carbide composite.

It is a further object of the present invention to provide a continuous process for forming said composite which utilizes roll compaction techniques to provide a thin strip material having desirable strength, tensile and thermal properties.

It is a further object of the present invention to provide a process as above which does not require the use of either a vacuum or an extrusion step.

It is a further object of the present invention to provide a process as above which is economically beneficial and commercially practical.

Other objects and advantages of the present invention will become more apparent from the following description.

In accordance with the present invention, a reinforced aluminum composite in strip form having an attractive set of mechanical properties is formed in a continuous manner by blending a powdered aluminum matrix material with a powdered reinforcing material, roll compacting the blended powders to form a green strip, and thereafter hot working the compacted materials to form a strong bond between the aluminum matrix material and the reinforcing material and to form a thin strip material having a desired thickness. Following hot working, the strip material may be subjected to thermal treatments, such as solution annealing and age hardening, as required.

In a preferred embodiment of the present invention, an aluminum-silicon carbide strip material is formed by blending pure aluminum or aluminum alloy powder and silicon carbide powder in an inert atmosphere, roll compacting the blended powders in an inert atmosphere, and directly hot rolling the compacted materials to form a strong bond between the aluminum alloy particles and the silicon carbide particles. It has been found that using this process, a fully dense product with tensile and thermal properties equivalent to those obtained by a vacuum hot pressing or HIP process, followed by extrusion, can be obtained.

Further details of the process of the present invention can be seen from the following description and examples.

BRIEF DESCRIPTION OF THE DRAWINGS

The figure is a photomicrograph of a cross-section of the material formed in accordance with Example VI.

DETAILED DESCRIPTION

In accordance with the present invention, an aluminum-silicon carbide composite in strip form is produced in a continuous and an economically attractive manner. As used herein, the term "strip form" includes strip material, sheet material, rods, wires or any other continuous form.

The process for forming the aluminum-silicon carbide composite begins with the provision of an aluminum matrix material in powdered form and a powdered reinforcing material such as silicon carbide. The aluminum matrix material may be powdered aluminum or a powdered aluminum alloy including alloys in the 2000 and 6000 series. Preferably, the powdered aluminum matrix material has particles with a size less than about 30 microns, preferably from about 5 microns to about 10 microns. The silicon carbide powder material may have a particle size in the range of from about 1 to about 30 microns, preferably from about 5 microns to about 10 microns.

The powdered materials may be blended together using any suitable gentle blending technique known in the art. For example, a twin shell V-blender may be used. Preferably, the powders are blended together in the presence of from about 0.02 wt. % to about 0.5 wt. % of a liquid for reducing the interparticle friction and for controlling the way the powder feeds during compaction. The liquid may be selected from the group consisting of kerosene and butanol. Additionally, the powdered materials are preferably blended together in an inert atmosphere of argon and/or nitrogen to avoid the formation of unwanted and deleterious oxides and to avoid the formation of explosive particle-air mixtures.

The powdered materials are mixed in a proportion which enables the finally fully dense material to have from about 10 vol. % to about 75 vol. % silicon carbide and from about 25 vol. % to about 90 vol. % aluminum matrix material. The proportion of silicon carbide to aluminum matrix material may vary depending upon the desired end use for the composite material. For example, composite materials which are to be used in thermal management applications will be fabricated by blending the materials together in a proportion which yields a finally fully dense material having from about 40 vol. % to about 75 vol. %, preferably from about 50 vol. % to about 65 vol. %, silicon carbide and from about 25 vol. % to about 60 vol. %, preferably from about 35 vol. % to about 50 vol. %, aluminum matrix material. For composite materials to be used in structural applications requiring increased stiffness, improved strength, reduced thermal expansion and good mechanical properties, the materials will be blended together in a proportion to yield a finally fully dense material having from about 10 vol. % to about 30 vol % silicon carbide and from about 70 vol. % to about 90 vol. % aluminum matrix material.

After blending, the powdered materials are roll compacted to form a green strip having a desired first thickness. The powdered materials are roll compacted by two horizontally opposed rolls with the powder fed into the roll nip in a uniform way, preferably in an inert atmosphere such as an argon and/or nitrogen atmosphere. The inert atmosphere is used to reduce the presence of oxygen and to reduce the possibility of forming deleterious and unwanted oxides during this step.

Following roll compacting, the green strip is directly hot worked by hot rolling to a desired second thickness. This thickness may be the final thickness of the strip material. Hot rolling is also carried out in an inert atmosphere using any suitable hot rolling device known in the art. In accordance with the present invention, hot rolling is carried out at a temperature in the range of from a temperature about 150° F. below the solidus temperature to a temperature of less than about 25° F. of the liquidus temperature of the aluminum matrix material so as to bond the aluminum matrix material particles to the silicon carbide particles. A preferred temperature range for performing this hot rolling step is from about 100° F. below the solidus temperature to about 50° F. below the solidus temperature of the aluminum matrix material.

If desired, hot rolling may be entirely or partly carried out at a temperature above the solidus temperature of the aluminum matrix material. At a temperature above the solidus, the aluminum matrix material will at least partly liquify and a stronger bond between the aluminum particles and the silicon carbide particles will be formed. The use of super solidus temperatures also facilitates the hot rolling process and is beneficial in breaking up unwanted oxide films. Of course, hot rolling at a temperature above the solidus should only be carried out for a relatively short time period, preferably less than a few minutes, to prevent chemical reaction between the aluminum and the carbide.

If desired, the green strip may be reduced in thickness to a desired final thickness in multiple hot rolling passes. For example, the green strip may first be reduced by hot rolling at a temperature below the solidus temperature of the aluminum matrix material. Then, it may be further reduced by hot rolling at a temperature above the solidus temperature of the aluminum matrix material. Thereafter, it may be reduced to a desired final thickness by hot rolling at a temperature below the solidus temperature of the aluminum matrix material.

Following hot rolling, the thin strip material may be subjected to thermal treatments if desired. For example, the thin strip material may be solution annealed at a temperature in the range of from about 890° F. to about 1050° F. depending on alloy composition for a time period in the range of from about 1 minute to about 240 minutes. After solution annealing, the thin strip may be water quenched and age hardened. Age hardening may be carried out at a temperature in the range of from about 250° F. to about 375° F. for a time period in the range of from about 7 hours to about 24 hours, or at room temperature for a period of about 1 to 5 days.

The process of the present invention is an attractive, economic method of making thin strip material because it is a near-net shape process and also because it is a continuous process, not a batch process. It has been surprisingly found that with the use of inert atmospheres and direct hot rolling of the green strip, a fully dense product is obtained with tensile and thermal properties equivalent to those obtained by vacuum hot pressing or HIP processing, followed by extrusion.

The following examples illustrate the process of the present invention and the tensile and elongation properties which can be obtained.

EXAMPLE I

A blend of 6061 aluminum alloy powdered screened to −400 mesh and silicon carbide powder of about 10 micron particle size (representing 20 volume percent of the final fully dense material) was made using a 0.1 weight percent kerosene addition. This powder was roll compacted into a green strip 4 inches wide and about 0.095 inches thick. A sample of this green strip was processed to a gauge of about 0.012 inches using a hot working temperature of 975° F. A solution anneal at 975° F. for 3 hours followed by an age hardening treatment of 7 hours at 300° F. resulted in the tensile properties shown in Table I.

EXAMPLE II

A second sample of the green strip from Example I was processed to a gauge of about 0.011 inches using a hot working temperature of 1030° F. A solution anneal at a temperature of 985° F. for three and one-half hours followed by an age hardening treatment of 7 hours at 300° F. resulted in the tensile properties shown in Table I.

EXAMPLE III

A third sample of the green strip from Example I was hot worked at 975° F. to a thickness of 0.057 inches, then at a super-solidus temperature of 1120° F. to a thickness of 0.035 inches, and finally at 975° F. to a thickness of 0.011 inches. A solution anneal at 975° F. for 24 hours followed by an age hardening treatment of 7 hours at 300° F. gave the tensile properties shown in Table I.

EXAMPLE IV

A blend of 6061 aluminum alloy powder screened to −325 mesh and silicon carbide powder of about 10 micron particle size (representing 20 volume percent of the final fully dense material) was made using a 0.1 percent kerosene addition. An argon atmosphere was used in the blending operation. This powder was roll compacted into a green strip 4 inches wide and about 0.100 inches thick. A sample of this strip was hot rolled directly at a temperature of 1030° F. in multiple passes to a final thickness of 0.011 inches. The strip was then annealed at 975° F. for three hours, water quenched, and aged at 300° F. for either 7 or 24 hours. Tensile data on the resultant strip are shown in Table I.

EXAMPLE V

A sample of the green strip from Example IV was directly hot rolled at a temperature of 1030° F. to a thickness of 0.068 inches in several passes, then hot rolled at a super solidus temperature of 1120° F. to a thickness of 0.033 inches, and then hot rolled at a temperature of 1030° F. to a final thickness of 0.011 inches. The strip was then annealed at 975° F. for 3 hours, water quenched, and aged at 300° F. for either 7 or 24 hours. Tensile data on the resultant strip are shown in Table I.

TABLE I

| EXAMPLE | UTS (ksi) | YS (ksi) | % ELONGATION (IN 1 INCH) |
|---|---|---|---|
| I | 58 | 45 | 4 |
| II | 43 | 29 | 4 |
| III | 52 | 42 | 3 |
| IV (7 hrs. age) | 51 | 38 | 4 |
| IV (24 hrs. age) | 56 | 47 | 3.5 |
| V (7 hr. age) | 54 | 39 | 6 |
| V (24 hr. age) | 57 | 48 | 4 |

A tensile strength after aging of 58 ksi (400 MPa) and a yield strength of 45 ksi (310 MPa) with an elongation of 4 percent represent comparable properties to those reported in the literature for extruded and aged material made by other methods. See reported data for 20 volume percent silicon carbide in an annealed and aged (T6) condition in the report "Production Extrusion of AA6061-SiC Metal Matrix Composites" by D. G. Evans et al.

EXAMPLE VI

A blend of aluminum powder (99.2 percent aluminum) of approximately 10 micron particle size and silicon carbide powder of about 10 micron particle size was made such that the final fully dense material would contain 55 percent by volume of silicon carbide. The powder was blended with 0.1 percent kerosene and 0.02% zinc stearate and compacted to a green gauge of 0.083 inch. A foil of aluminum 0.002 inches thick was placed on each surface of the compact and the composite was hot worked at 1175° F. to a gauge of 0.041 inches. Thermal expansion was measured using a differential dilatometer and the result is shown in Table II. The values are significantly lower than would be expected from a rule of mixtures calculation, indicating excellent bonding of the silicon carbide particles to the aluminum matrix. The figure shows a photomicrograph of the cross-section of the material.

TABLE II

| TEMPERATURE RANGE (°C.) | COEFFICIENT OF THERMAL EXPANSION $\times 10^{-6}$ °C.$^{-1}$ |
|---|---|
| 30–150 | 9.9 |
| 30–200 | 10.1 |
| 30–250 | 10.2 |
| 30–300 | 10.2 |

For certain applications, the composite strip material of the present invention may be clad with a metallic material to provide an improved surface finish. For example, the composite material of the present invention may be clad on one or more surfaces with a 100% aluminum material or an aluminum alloy. Cladding may be carried out using any suitable cladding technique known in the art. Cladding would be helpful in environments where plating of the composite strip material is required or where a smooth finish is desired.

It is apparent that there has been provided in accordance with this invention an aluminum-silicon carbide composite and process for making same which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the Spirit and broad scope of the appended claims.

What is claimed is:

1. A process for continuously forming a reinforced aluminum strip material which comprises:

providing an aluminum matrix material in powdered form and a reinforcing material in powdered form;

blending said powdered aluminum matrix material and said powdered reinforcing material in an inert atmosphere;

roll compacting said blended materials in an inert atmosphere to form a green strip having a first thickness; and directly hot working said blended and roll compacted materials at a temperature no lower than about 150° F. below the solidus temperature of the aluminum matrix material to bond particles of said aluminum matrix material to particles of said reinforcing material and to form a thin strip material having a second thickness less than said first thickness.

2. The process of claim 1 wherein said reinforcing material comprises powdered silicon carbide and said blending step comprises blending said aluminum matrix material and said silicon carbide in a proportion sufficient to yield a fully dense product having from about 30 vol. % to about 90 vol. % of said aluminum matrix material with about 10 vol. % to about 70 vol. % of said silicon carbide.

3. The process of claim 2 wherein said blending step further comprises blending said aluminum matrix material and said silicon carbide with from about 0.02 wt. % to about 0.5 wt. % of a liquid for reducing interparticle friction between said aluminum matrix material and said silicon carbide.

4. The process of claim 1 wherein said reinforcing material comprises powdered silicon carbide and said blending step comprises blending said aluminum matrix material and said silicon carbide in a proportion which yields a fully dense product having from about 40 vol. % to about 75 vol. % of said silicon carbide and from about 25 vol. % to about 60 vol. % of said aluminum matrix material.

5. The process of claim 1 wherein said reinforcing material comprises powdered silicon carbide and said blending step comprises blending said aluminum matrix material and said silicon carbide in a proportion which yields a fully dense product having from about 50 vol. % to about 65 vol. % of said silicon carbide and from about 35 vol. % to about 50 vol. % of said aluminum matrix material.

6. The process of claim 1 wherein said reinforcing material comprises powdered silicon carbide and said blending step comprises blending said aluminum matrix material and said silicon carbide in a proportion which yields a fully dense product having from about 10 vol. % to about 30 vol. % of said silicon carbide and from about 70 vol. % to about 90 vol. % of said aluminum matrix material.

7. The process of claim 1 wherein said hot working step comprises directly hot rolling said blended and roll compacted materials to form said thin strip material, said hot rolling step being carried out in an inert atmosphere.

8. The process of claim 7 wherein said hot rolling step includes hot rolling said materials at a temperature above the solidus temperature of said aluminum matrix material to at least partially liquify said aluminum matrix material and thereby improve the bond between said aluminum matrix material particles and said reinforcing material particles.

9. The process of claim 1 wherein said hot working step is carried out at a temperature in the range of from a temperature about 150° F. below the solidus temperature of the aluminum matrix material to a temperature within 25° F. of the liquidus temperature of said aluminum matrix material.

10. The process of claim 1 wherein said hot working step is carried out at a temperature in the range of from about 100° F. below the solidus temperature to about 50° F. below the solidus temperature of the aluminum matrix material.

11. A process for forming a reinforced aluminum strip material which comprises:

providing an aluminum matrix material in powdered form and a reinforcing material in powdered form;

blending said powdered aluminum matrix material and said powdered reinforcing material in an inert atmosphere;

roll compacting said blended materials in an inert atmosphere to form a green strip having a first thickness;

directly hot working said blended and roll compacted materials to bond particles of said aluminum matrix material to particles of said reinforcing material and to form a thin strip material having a second thickness less than said first thickness; and said hot working step comprising first hot working said blended and compacted materials at a first temperature below the solidus temperature of said aluminum matrix material, then hot working said blended and compacted materials at a temperature above said solidus temperature of said aluminum matrix material, and thereafter hot working said blended and compacted materials at a temperature below said solidus temperature.

12. The process of claim 1 further comprising:

solution annealing said thin strip material at a temperature in the range of from about 890° F. to about 1050° F. for a time period in the range of from about 1 minute to about 240 minutes;

quenching said thin strip material after said solution annealing; and age hardening said quenched thin strip material.

13. The process of claim 12 wherein said age hardening step comprises age hardening said material for a time period in the range of from about 7 hours to about 24 hours at a temperature in the range of from about 250° F. to about 375° F.

14. The process of claim 12 wherein said age hardening step comprises age hardening said material at room temperature for a time period in the range of from about 1 to about 5 days.

15. The process of claim 1 wherein said blending step comprises blending a powdered aluminum matrix material having particles of a size in the range of from about 5 microns to about 30 microns with silicon carbide particles in the range of from about 5 microns to about 30 microns.

16. The process for continuously forming an aluminum silicon carbide composite strip material which comprises:

blending powdered silicon carbide particles having a particle size less than about 30 microns with a sufficient amount of powdered aluminum matrix material having a particle size in the range of from about 5 microns to about 30 microns to yield a fully dense product containing about 10 vol. % to about 70 vol. % silicon carbide and from about 30 vol. % to about 90 vol. % aluminum matrix material;

roll compacting said blended aluminum matrix material and silicon carbide materials in an inert atmosphere to form a green strip having a first thickness; and hot rolling said green strip in an inert atmosphere at a temperature in the range of from about 150° F. below the solidus temperature at said aluminum matrix material to about within 25° F. of the liquidus temperature of said aluminum matrix material to bond said aluminum matrix material particles to said silicon carbide particles and to form a thin strip material having a second thickness less than said first thickness.

17. A process for continuously forming an aluminum silicon carbide composite strip material which comprises:

blending powdered silicon carbide particles having a particle size less than about 30 microns with a sufficient amount of powdered aluminum matrix material having a particle size in the range of from about 5 microns to about 30 microns to yield a fully dense product containing about 10 vol. % to about 70 vol. % silicon carbide and from about 30 vol. % to about 90 vol. % aluminum matrix material;

roll compacting said blended aluminum matrix material and silicon carbide materials in an inert atmosphere to form a green strip having a first thickness;

hot rolling said green strip in an inert atmosphere at a temperature in the range of from about 150° F. below the solidus temperature at said aluminum matrix material to about within 25° F. of the liquidus temperature of said aluminum matrix material to bond said aluminum matrix material particles to said silicon carbide particles and to form a thin strip material having a second thickness less than said first thickness; and said blending step further comprising blending from about 0.02 wt. % to about 0.5 wt. % of kerosene to said powdered aluminum matrix material and said silicon carbide particles to reduce interparticle friction.

18. The process of claim 16 wherein said aluminum matrix material comprises powdered aluminum.

19. The process of claim 16 wherein said aluminum matrix material comprises a powdered aluminum alloy.

20. The process of claim 16 further comprising cladding said thin strip material on at least one surface with a metallic material so as to provide a relatively smooth surface finish on said at least one surface.

* * * * *